US005843007A

United States Patent [19]

McEwen et al.

[11] Patent Number: 5,843,007

[45] Date of Patent: Dec. 1, 1998

[54] APPARATUS AND METHOD FOR PERIODICALLY APPLYING A PRESSURE WAVEFORM TO A LIMB

[76] Inventors: James Allen McEwen, 10551 Bamberton Drive, Richmond, B.C., Canada, V7A 1K6; Michael Jameson, 2365 Badger Road, North Vancouver, B.C., Canada, V7G 1S9

[21] Appl. No.: 639,782

[22] Filed: Apr. 29, 1996

[51] Int. Cl.[6] ..... A61H 9/00

[52] U.S. Cl. ..... 601/152; 601/151; 601/150; 601/149

[58] Field of Search ..... 601/148, 149, 601/150, 151, 152

[56] References Cited

U.S. PATENT DOCUMENTS

| | | | |
|---|---|---|---|
| 3,892,229 | 7/1975 | Taylor et al. | 601/152 |
| 4,013,069 | 3/1977 | Hasty . | |
| 4,331,133 | 5/1982 | Arkans . | |
| 4,375,217 | 3/1983 | Arkans . | |
| 4,396,010 | 8/1983 | Arkans . | |
| 4,408,599 | 10/1983 | Mummert . | |
| 4,419,988 | 12/1983 | Mummert . | |
| 4,469,099 | 9/1984 | McEwen | 606/202 |
| 4,479,494 | 10/1984 | McEwen . | |
| 4,605,010 | 8/1986 | McEwen . | |
| 4,770,175 | 9/1988 | McEwen . | |
| 4,841,956 | 6/1989 | Gardner et al. . | |
| 4,869,265 | 9/1989 | McEwen . | |
| 5,007,411 | 4/1991 | Dye . | |
| 5,022,387 | 6/1991 | Hasty . | |
| 5,031,604 | 7/1991 | Dye . | |
| 5,048,536 | 9/1991 | McEwen . | |
| 5,181,522 | 1/1993 | McEwen . | |
| 5,254,087 | 10/1993 | McEwen . | |
| 5,312,431 | 5/1994 | McEwen . | |
| 5,437,610 | 8/1995 | Cariapa et al. . | |
| 5,439,477 | 8/1995 | McEwen . | |
| 5,443,440 | 8/1995 | Tumey et al. | 601/152 |

FOREIGN PATENT DOCUMENTS

| | | |
|---|---|---|
| WO93/12708 | 7/1993 | WIPO . |
| WO95/18594 | 7/1995 | WIPO . |
| WO95/22307 | 8/1995 | WIPO . |
| WO95/26705 | 10/1995 | WIPO . |
| CA97/00273 | 8/1997 | WIPO . |

*Primary Examiner*—Kien T. Nguyen
*Assistant Examiner*—Benjamin K. Koo
*Attorney, Agent, or Firm*—Hancock Meininger & Porter LLP

[57] ABSTRACT

Apparatus for applying a pressure waveform to a patient's limb for augmenting venous blood flow in the limb comprises: a sleeve means adapted to position onto a limb and apply a pressure to the limb near a pressure corresponding to a sleeve pressure signal; pressure transducing means for producing an applied pressure signal indicative of the pressure applied to the limb by the sleeve means; waveform register means for producing a reference pressure waveform signal indicative of a reference pressure waveform during a predetermined cycle time period, wherein the amplitude of the reference pressure waveform signal at any instant within the cycle time period is indicative of the amplitude of the reference pressure waveform at the instant and wherein the shape of the reference pressure waveform during a predetermined time interval within the cycle time period is adapted to augment the flow of venous blood into the limb proximal to the sleeve means from the limb beneath the sleeve means during the interval; and pressure waveform application means responsive to the applied pressure signal and the reference pressure waveform signal and operable by producing the sleeve pressure signal to maintain the difference between the pressure indicated by the applied pressure signal and the pressure indicated by the reference pressure waveform signal at less than a predetermined pressure difference at any instant within the cycle time period.

15 Claims, 9 Drawing Sheets

APPARATUS AND METHOD FOR PERIODICALLY APPLYING A PRESSURE WAVEFORM TO A LIMB

FIELD OF THE INVENTION

The invention is related to an apparatus and method for periodically producing a pressure waveform in a pneumatic sleeve applied to a limb of a human patient in order to help prevent deep vein thrombosis (DVT) or to treat lymphedema in the patient.

BACKGROUND OF THE INVENTION

Limb compression systems of the prior art apply and release pressure on a patient's extremity to augment venous blood flow and help prevent deep vein thrombosis (DVT) or to treat lymphedema. Limb compression systems of the prior art typically include: a source of pressurized gas; one or more pneumatic sleeves for attaching to one or both of the lower limbs of a patient; and an instrument connected to the source of pressurized gas and connected to the sleeves by means of pneumatic tubing, for controlling the inflation and deflation of the sleeves and their periods of inflation and deflation. In U.S. Pat. No. 3,892,229 Taylor et al. describe an early example of one general type of limb compression system of the prior art known as an intermittent limb compression system; such systems apply pressure intermittently to each limb by inflating and deflating a single-bladder sleeve attached to the limb. In U.S. Pat. No. 4,013,069 Hasty describes an example of a second general type of limb compression system of the prior art, known as a sequential limb compression system; such systems apply pressure sequentially along the length of the limb by means of a multiple-bladder sleeve or multiple sleeves attached to the same limb which are inflated and deflated at different times. Certain intermittent and sequential limb compression systems of the prior art are designed to inflate and deflate sleeves on both limbs either simultaneously or alternately, while others are designed for use on one limb only.

The primary purpose of most of the limb compression systems of the prior art is to prevent or reduce the risk of DVT. Such limb compression systems are used to minimize venous stasis during and immediately following surgery, as well as during long periods of immobility. DVT may lead to pulmonary embolism (PE), a serious hazard for surgical and trauma patients. For example, patients over forty years of age who are undergoing hip or knee surgery, or major abdominal surgery, are at particular risk of DVT. When DVT leads to PE, this complication can result in death, with an estimated 200,000 such deaths occurring in the United States annually. To help prevent DVT and thus PE, the use of pneumatic limb compression systems of both intermittent and sequential types, used either alone or combined with anticoagulant drug therapy, have been developed in the prior art and are commonly used at present.

A purpose of other limb compression systems of the prior art is to treat chronic edema, including lymphedema. Lymphedema refers to the condition of fluid accumulation in a limb. Secondary lymphedema can be a result of trauma or surgical complications. Limb compression therapy using limb compression systems of the prior art has been demonstrated to be of significant value in treating lymphedema.

Systems of the prior art have not been capable of producing a desired pressure waveform in a pneumatic sleeve attached to a limb. This is a significant limitation, as the inventors of the present invention have inferred from the recent clinical literature that applied pressure waveforms having differing shapes produce significantly different changes to venous blood flow. In the clinical literature, the use of a wide range of devices and non-standardized techniques by clinicians to indicate changes in venous flow and venous stasis, either subjectively or quantitatively, has been reported. For example, devices employing Doppler ultrasound, photo-plethysmography, impedance plethysmography, contrast venography, oximetry and de-oximetry have all been used for such purposes in the prior art. Such changes, when detected, then may or may not have been taken into consideration in the manual adjustment of prior-art systems. For example, Tumey et al. in U.S. Pat. No. 5,443,440 describe apparatus including a sensor for determining whether patients have venous blood flow problems prior to setting parameters and use. However, a significant limitation of many prior-art limb compression systems is that such systems have not incorporated a standardized physiologic transducer and measurement algorithm which provides an indication of the change in venous blood flow produced as a result of the application of a pressure waveform to by means of the sleeve of the system. As a result, these prior-art systems cannot automatically adapt or change the pressure waveform applied to the limb, nor can they permit an operator to manually adapt or change the pressure waveform, in response to changes in venous blood flow, in order to improve the effectiveness of the therapy.

In many sequential limb compression systems of the prior art, such as the one described by Hasty in U.S. Pat. No. 4,013,069, elapsed times are pre-set to initiate the sequential pressurization of each of the multiple-chamber sleeves, or each of the multiple sleeves. This has been a significant limitation and has produced a sub-optimal augmentation of venous blood flow by such sequential limb compression systems, but has been necessary because these prior-art systems have not been capable of producing desired pressure waveforms in multiple-bladder sleeves and multiple sleeves, and have thus not been capable of using a selected parameter of the pressure waveform in one sleeve or bladder of a multiple-bladder sleeve to trigger the pressurization of another sleeve or bladder using the desired pressure waveform for that sleeve or bladder.

Many limb compression systems of the prior art are not capable of producing a desired pressure waveform in a pneumatic sleeve attached to a limb either because they do not directly measure the pneumatic pressure in the sleeve at any instant, or because they do not generate a signal indicative of the pressure suitable for permitting a feedback control system to produce the desired pressure waveform. In the prior art, for example, pressure gauges have been connected to inflatable bladders to provide visual indications of bladder pressure to operators, but such apparatus did not generate a signal suitable for controlling the production of a waveform and the apparatus was considered to be expensive, inconvenient and unnecessary.

Some limb compression systems of the prior art attempt to prevent hazardous over-pressurization by limiting the maximum pressure level produced in the sleeve without actually displaying or measuring the sleeve pressure. For example, in U.S. Pat. No. 4,841,956 Gardner et al. describe a limb compression system in which sleeve pressure is not measured, but in which the peak pressure level is limited by limiting the time period during which inflating gas flows into the sleeve. In such a system the maximum pressure actually produced in the sleeve is dependent on variables such as the flow resistance of the tubing, the design and pneumatic volume of the sleeve, and the pressure of the gas during the inflating time period. Other systems, such as that of Arkans in U.S. Pat. No. 4,396,010, use a preset pressure switch in the instrument to limit the maximum pneumatic pressure level.

In a limb compression system described by Cariapa et al. in U.S. Pat. No. 5,437,610, a pressure sensor is connected to a fluid-filled bladder within a pneumatic sleeve, but the sensor/bladder combination is adapted to measure the static pressure of the limb against the uninflated sleeve, and could not be used or adapted to produce any one of a wide range of desired pneumatic pressure waveforms in the sleeve.

Some limb compression systems known in the prior art attempt to estimate sleeve pressure in an inexpensive and convenient manner, based on a variety of apparatus and methods. These systems do not measure pressure directly in the pneumatic sleeve applied to the limb but instead estimate sleeve pressure indirectly and remotely from the sleeve. For example, in U.S. Pat. No. 5,031,604 Dye describes a system in which sleeve pressure is estimated by measuring pneumatic pressure near the instrument end of the tubing connecting the instrument to the sleeve. As another example, Arkans in U.S. Pat. No. 4,375,217 describes a system in which the static pressure in the sleeve is estimated at a location on the tubing between the instrument and the sleeve. All such apparatus and methods which estimate sleeve pressure by measuring a pneumatic pressure remotely from the sleeve suffer from a significant disadvantage, which makes them unsuitable for incorporation into an instrument for producing a desired pressure waveform in the sleeve: the accuracy of the estimates of pressure made by such systems is significantly affected by variations in the length and flow resistance of the tubing attached to the sleeve, and by variations in sleeve design, sleeve inflation volume and sleeve application technique. For example, the inventors of the present invention have determined that variables related to the design and size of the sleeve, as well as the snugness of application of the sleeve, can result in discrepancies at any instant of well over 50 percent between the remotely estimated sleeve pressure and the actual pressure in the sleeve. As a separate consideration regarding the flow resistance of the tubing employed in prior-art systems which measure pressure in this manner, it has been necessary to locate such systems close to the patient to minimize flow resistance in the tubing, resulting in unnecessary noise and clutter around the patient.

Other systems known in the prior art interrupt the flow of gas in the tubing in an effort to estimate sleeve pressure by measuring pneumatic pressure at the instrument end of the tubing under zero-flow conditions. One such system is the Jobst Athrombic Pump System 2500 (Jobst Institute Inc., Charlotte N.C.). However, estimates of sleeve pressure made in this manner cannot practically be incorporated into limb compression systems for producing pressure waveforms having large amplitudes and short cycle periods. Also, more generally, such systems suffer from the disadvantage that pressure estimates are available discontinuously and are not suitable for real-time control of the pressure in the sleeve to produce a desired pressure waveform.

In the prior art, incorporation of a force sensor to measure the force applied by a sleeve to a limb has been described by Tumey et al. in U.S. Pat. No. 5,443,440. Also, the use of separate measurement apparatus for measuring the pressure applied by a sleeve to a limb has been described by Arkans in U.S. Pat. No. 4,331,133, wherein a separate measurement cuff is placed between the sleeve and the limb and the pressure applied by the sleeve is estimated indirectly. Both the above-referenced force sensor of Tumey et al. and separate measurement apparatus of Arkans have several disadvantages which make them unsuitable for incorporation into a system for periodically applying a desired pressure waveform to a limb: calibration of the force sensor/measurement cuff is difficult, time-consuming and error-prone; significant errors can arise during use due to use-related changes in the interface between force sensor/measurement cuff and the sleeve, or between the force sensor/measurement cuff and the limb; and minor anomalies such as wrinkling or folding of the sleeve or cuff surface when inflated can produce significant anomalies in measured force/pressure.

Because of errors and limitations associated with estimation of the pressure applied by a sleeve to a limb, prior-art systems have not had the capability of accurately producing a desired pressure waveform in combination with sleeves having differing designs and varying pneumatic volumes, or when sleeve application techniques vary and the resulting sleeve snugness varies, or when sleeves are applied to limbs of differing sizes, shapes and tissue characteristics. As a result, clinical staff using such prior-art systems have very inaccurate and limited knowledge of what pressure waveforms have actually being applied to the patient, relative to what was prescribed.

In U.S. Pat. No. 5,443,440 Tumey et al. describe a limb compression system capable of creating and storing the time, date and duration of each use of the system for subsequent transmission to a physician's computer. However, sequential and intermittent limb compression systems known in the prior art do not record parameters related to the periodic application of a desired pressure waveform, such as any differences between the actual shape of the pressure waveform produced in the pneumatic sleeve and the shape of a desired reference pressure waveform, the time and duration during which the waveform was periodically applied, and the number of cycles of the waveform which were applied. Additionally, limb compression systems known in the prior art do not subsequently produce the recorded values of these parameters for use by physicians in determining the extent to which the desired pressure waveform was actually applied, for use by third-party payors in reimbursing for therapy actually provided, and for use in patient outcome studies where variations in these parameters of therapy are thought to be related to variations in patient outcomes, leading to optimization of waveform-related parameters and thus improved therapy.

It is an object of the present invention to periodically apply a desired pressure waveform to a limb by periodically producing the desired pressure waveform in a pneumatic sleeve attached to the limb. A related object of the present invention is to have the capability of storing in a waveform register a reference waveform having any one of a wide range of desired wave shapes and cycle periods.

Another related object of the present invention is to customize therapy parameters to follow a therapy protocol or clinical practice guideline adopted by the operator, by including the capability for the operator to record in a configuration register values of parameters related to the desired pressure waveform, as well as the number and timing of waveform cycles to be applied, and by including the capability for those recorded parameters to be retrieved and used to apply that desired pressure waveform and therapy protocol to the patient.

Another related object of the present invention is to record in a therapy register parameters related to the pressure waveforms actually applied to the limb, and to subsequently produce on request the recorded values of these waveform-related parameters for use by physicians in determining the extent to which the desired pressure waveforms were actually applied, for use by third-party payors in reimbursing for therapy actually provided, and for use in patient outcome studies where variations in these parameters of therapy are thought to be related to variations in patient outcomes, leading to optimization of waveform-related parameters and thus improved therapy.

An object related to the safety of the present invention is to incorporate a safety circuit capable of determining, for each of the anticipated modes of operation of the invention, when the pneumatic valves employed in those modes are malfunctioning and if so for providing a warning signal.

SUMMARY OF THE INVENTION

The invention is directed to apparatus for applying a pressure waveform to a patient's limb for augmenting venous blood flow in the limb, comprising: an inflatable sleeve adapted for positioning onto a limb to apply a pressure to the limb beneath the sleeve when inflated with gas; pressure transducing means for sensing the pressure of gas in the sleeve and for producing a sleeve pressure signal indicative of the sensed pressure; pressure waveform application means responsive to the sleeve pressure signal and a reference pressure waveform signal and operable by supplying gas to the sleeve at a pressure which produces a sensed pressure near a pressure indicated by a reference pressure waveform; and waveform register means for producing a reference pressure waveform signal indicative of a reference pressure waveform during a predetermined cycle time period, wherein the amplitude of the reference pressure waveform signal at any time within the cycle time period is indicative of the amplitude of the reference pressure waveform at the time and wherein the variation in amplitude of the reference pressure waveform during a predetermined time interval within the cycle time period is adapted to augment the flow of venous blood into the limb proximal to the sleeve from the limb beneath the sleeve during the predetermined time interval. The variation in amplitude of the reference pressure waveform during the predetermined time interval may be adapted to augment the flow of venous blood by increasing the maximum velocity of venous blood flowing into the limb proximal to the sleeve in response to the variation in amplitude during the predetermined time interval.

Advantageously, the inflatable sleeve includes a first sleeve connector means communicating pneumatically with the inflatable sleeve and a second sleeve connector means communicating pneumatically with the inflatable sleeve, and the first sleeve connector means does not communicate pneumatically with the second sleeve connector means except through the sleeve. Additionally, the pressure waveform application means may include a pressure waveform application connector for connecting to the first sleeve connector means so that the pressure waveform application means communicates pneumatically with the sleeve, and the pressure transducing means may include a pressure transducing connector for connecting to the second sleeve connector so that the pressure transducing means communicates pneumatically with the sleeve and communicates pneumatically with the pressure waveform application means only though the sleeve.

Alarm means responsive to the sleeve pressure signal and the reference pressure waveform signal may be included for producing an alarm signal near an alarm time when the difference between the pressure indicated by the level of the sleeve pressure signal and the pressure indicated by the reference pressure waveform signal is greater than a predetermined pressure difference. The apparatus may also include therapy register means responsive to the alarm signal, to the sleeve pressure signal and to the reference pressure waveform signal for recording the amplitudes of the sleeve pressure signal and the reference pressure waveform signal near the alarm time when the alarm signal is produced and for enabling an operator to determine at a time subsequent to the alarm time the sleeve pressure and the reference waveform pressure indicated by the levels of the sleeve pressure signal and the reference pressure waveform signal recorded near the alarm time.

DETAILED DESCRIPTION OF THE PREFERRED EMBODIMENT

The embodiment illustrated is not intended to be exhaustive or limit the invention to the precise form disclosed. It is chosen and described in order to explain the principles of the invention and its application and practical use, and thereby enable others skilled in the art to utilize the invention.

In the context of the preferred embodiment, a pressure waveform is generally considered to be a curve that represents the desired or actual amplitude of pressure in a pneumatic sleeve applied to a patient over time, and is described by a graph in rectangular coordinates whose abscissas represent times and whose ordinates represent the values of the pressure amplitude at the corresponding times. A cycle time period of the pressure waveform is generally considered to be the period of time during which one desired pressure waveform is completed. A phase of the pressure waveform is generally considered to be a portion of the pressure waveform occurring during an interval of time within the cycle time period of the pressure waveform. In the context of the preferred embodiment, periodic generation of a pressure waveform is generally considered to be the repetitive production of the pressure waveform in a pneumatic sleeve applied to a patient.

The preferred embodiment of the invention is described in three sections below: instrumentation, software and sleeves.

I. Instrumentation

Figure 1:
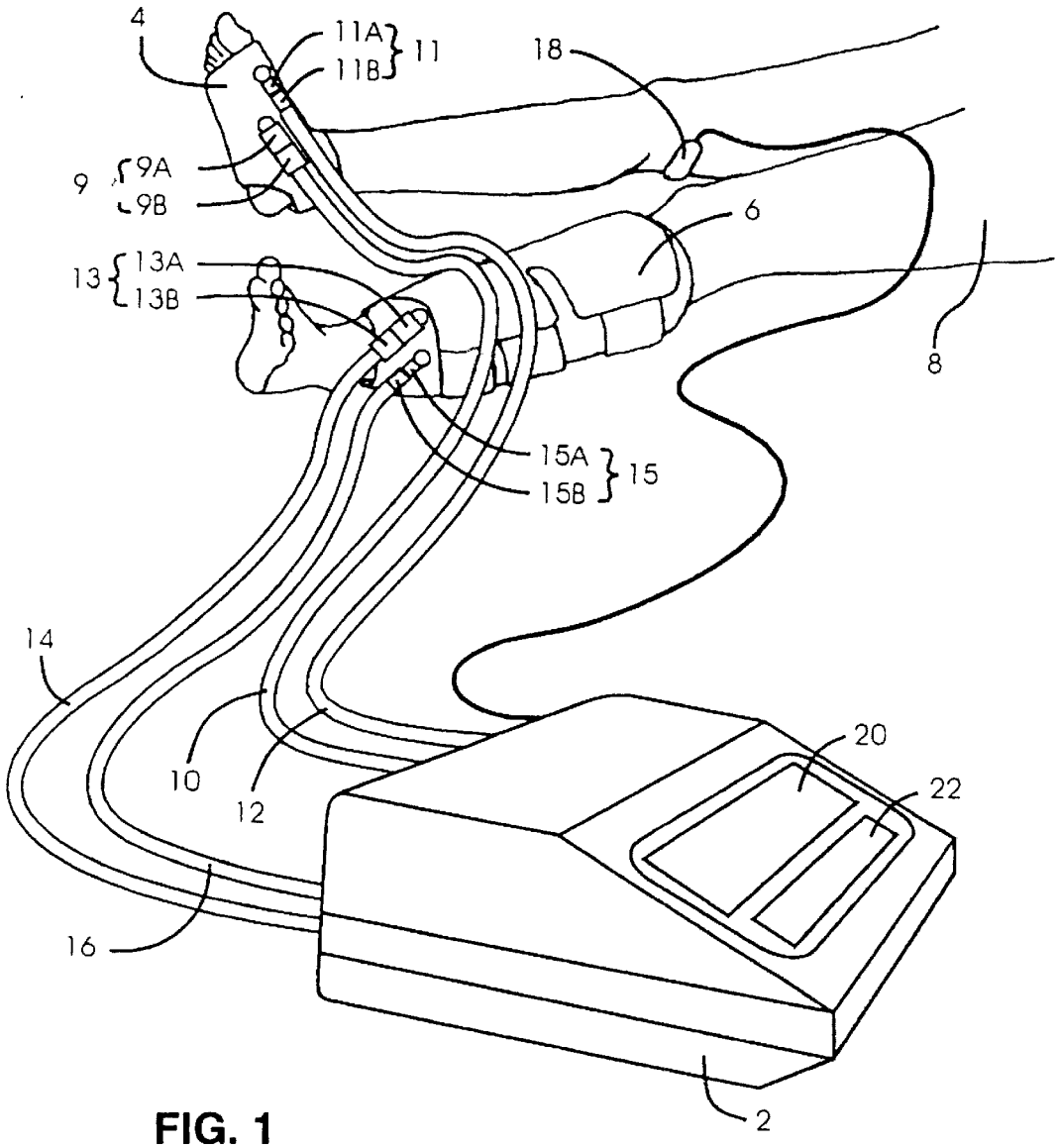
FIG. 1 is a pictorial representation of the preferred embodiment in a typical clinical application.

FIG. 1 depicts instrument 2 connected to two inflatable sleeves, foot sleeve 4 and calf sleeve 6. Foot sleeve 4 is suitable for applying a compressive pressure waveform to the plantar region of the foot, and is depicted applied to the right foot of a patient 8. Foot sleeve 4 is shown in detail in FIGS. 8 and 9 and described further below. Calf sleeve 6 is suitable for applying a compressive pressure waveform to the calf and is depicted applied to the left calf of patient 8. Calf sleeve 6 is shown in detail in FIGS. 10 and 11 and is also described below. Alternatively, other designs of sleeves, applied to other regions of the lower or upper limb, may be employed. Instrument 2 has two channels, channel "A" and channel "B". Inflatable sleeves 4 and 6 applied to patient 8 are connected to channels "A" and "B" of instrument 2. Instrument 2 repetitively produces a desired pressure waveform in foot sleeve 4 connected to channel "A" of instrument 2, and repetitively produces another desired pressure waveform in calf sleeve 6 connected to channel "B" of instrument 2, in order to augment the flow of venous blood from the portions of the limbs beneath sleeves 4 and 6 into portions of the limbs proximal to sleeves 4 and 6. Channel "A" and channel "B" of instrument 2 operate independently, and may generate different or similar pressure waveforms, as determined by an operator.

Figure 2:
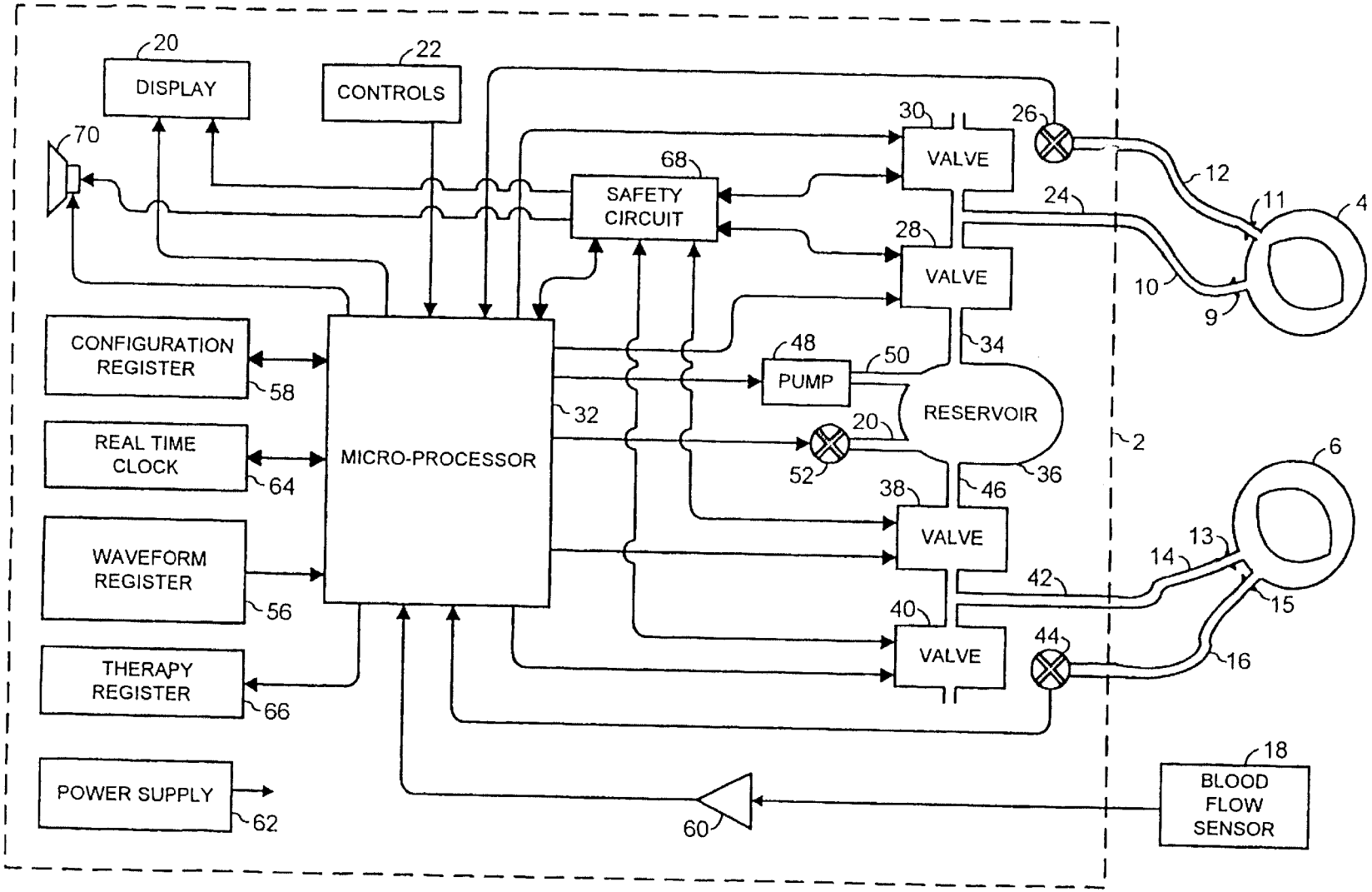
FIG. 2 is a block diagram of the preferred embodiment.

To enable a better appreciation of the versatility of the invention, instrument 2 is depicted in FIGS. 1 and 2 with channel "A" connected to foot sleeve 4 and channel "B" connected to calf sleeve 6, to apply pressures to the foot of the right leg and to the calf of the left leg of patient 8, as may be desirable during a surgical procedure. In other clinical applications, channels "A" and "B" of instrument 2 may be connected to two foot sleeves for applying pressure waveforms to each foot of a patient, or to two calf sleeves for applying pressure waveforms to each calf of a patient. Alternatively, instrument 2 may be connected to only one sleeve, or two sleeves of different design applied to the same limb for applying pressure waveforms sequentially in time.

As can be seen in FIG. 1, an inflatable portion of foot sleeve 4 communicates pneumatically with channel "A" of instrument 2 by means of pneumatic connector 9 and pneumatic tubing 10, and by means of pneumatic connector 11 and pneumatic tubing 12. Connector 9 comprises sleeve connector 9*a* non-releasably attached to foot sleeve 4 and mating tubing connector 9*b* non-releasably attached to tubing 10. Connector 11 comprises sleeve connector 11*a* non-releasably attached to foot sleeve 4 and mating tubing connector 11*b* non-releasably attached to tubing 12. In the preferred embodiment connector 9*a* is physically incompatible with connector 11*b* and does not mate with connector 11*b*. Connector 11*a* is physically incompatible with connector 9*b* and does not mate with connector 9*b*.

An inflatable portion of calf sleeve 6 communicates pneumatically with channel "B" of instrument 2 by means of pneumatic connector 13 and pneumatic tubing 14, and by means of pneumatic connector 15 and pneumatic tubing 16. Connector 13 comprises sleeve connector 13*a* non-releasably attached to calf sleeve 6 and mating tubing connector 13*b* non-releasably attached to tubing 14. Connector 15 comprises sleeve connector 15*a* non-releasably attached to calf sleeve 6 and mating tubing connector 15*b* non-releasably attached to tubing 16. In the preferred embodiment connector 13*a* is physically incompatible with connector 15*b* and does not mate with connector 15*b*. Connector 15*a* is physically incompatible with connector 13*b* and does not mate with connector 13*b*.

As shown in FIG. 1, venous blood flow sensor 18 is applied to the right popliteal region located behind the knee of patient 8 and located proximally to calf sleeve 6, and venous blood flow sensor 18 is electrically connected to instrument 2. Sensor 18 estimates venous blood flow in the limb proximal to calf sleeve 6 using an ultrasonic Doppler technique and is further described below.

Liquid crystal graphic display 20 shown in FIGS. 1 and 2 forms part of instrument 2 and is used to display information to the operator of instrument 2. Display 20 is employed for the selective presentation of any of the following information as described below: (a) menus of commands for controlling instrument 2, from which an operator may make selections; (b) parameters having values which characterize the sleeve pressure waveforms to be produced in inflatable sleeves connected to channels "A" and "B" of instrument 2; (c) text messages describing current alarm conditions, when alarm conditions are determined by instrument 2; (d) graphical representations of venous blood flow signals produced by sensor 18; and (e) messages which provide operating information to the operator.

Controls 22 shown in FIGS. 1 and 2 provide a means for an operator to control the operation of instrument 2.

Referring the block diagram of instrument 2 depicted in FIG. 2, foot sleeve 4 communicates pneumatically with valve manifold 24 through pneumatic connector 9 and pneumatic tubing 10. Foot sleeve 4 also communicates pneumatically with pressure transducer 26 through pneumatic connector 11 and pneumatic tubing 12. Valve 28 and valve 30 communicate pneumatically with manifold 24. Valve 28, valve 30, manifold 24 and pressure transducer 26 comprise the principal pneumatic elements of channel "A" of instrument 2.

In the preferred embodiment valve 28 is an electrically actuated, normally closed, proportional valve and valve 30 is an electrically actuated, normally open, proportional valve. Valves 28 and 30 respond to certain valve control signals generated by microprocessor 32. The level of the valve control signals presented to each of valves 28 and 30 by microprocessor 32 determines the degree to which valve 28 opens and the degree to which valve 30 closes. The level of the valve control signals thereby affects the pressure of gas in foot sleeve 4 by changing the rate of gas flow into and out of manifold 24.

Pressure transducer 26 communicates pneumatically with the inflatable portion of foot sleeve 4 by means of tubing 12 and connector 11. As shown in FIGS. 1 and 2 pressure transducer 26 does not communicate pneumatically with valve manifold 24 except through foot sleeve 4. In this way, pressure transducer 26 directly and continuously measures the pressure of gas in the inflatable portion of foot sleeve 4, and is unaffected by variables including the flow resistance of tubing 10, the flow resistance of connector 9, the design of foot sleeve 4, the pneumatic volume of the inflatable portion of foot sleeve 4, and the snugness of application of foot sleeve 4 to the limb of patient 8. Pressure transducer 26 is electrically connected to an analog to digital converter (ADC) input of microprocessor 32 and generates a channel "A" sleeve pressure signal, the level of which is representative of the pressure of gas in foot sleeve 4.

Valve 28 communicates pneumatically with manifold 24 and through tubing 34 to gas pressure reservoir 36, a sealed pneumatic chamber having a fixed volume of 750 ml. When activated valve 28 permits the flow of gas from reservoir 36 to manifold 24 and therefrom supplies pressurized gas through tubing 10 and connector 9 to the inflatable portion of foot sleeve 4. Valve 30 pneumatically connects manifold 24 to atmosphere, allowing a controlled reduction of pressure from foot sleeve 4.

Valve 38, valve 40, manifold 42 and pressure transducer 44 comprise the principal pneumatic elements of channel "B" of instrument 2, and are configured as shown in FIG. 2 and described below. Calf sleeve 6 communicates pneumatically with valve manifold 42 through pneumatic connector 13 and pneumatic tubing 14. Calf sleeve 6 also communicates pneumatically with pressure transducer 44 through pneumatic connector 15 and pneumatic tubing 16.

Valve 28 and valve 40 communicate pneumatically with manifold 42. In the preferred embodiment valve 38 is an electrically actuated, normally closed, proportional valve and valve 40 is an electrically actuated, normally open, proportional valve. Valves 38 and 40 respond to valve control signals generated by microprocessor 32. The level of the valve control signals influence the pressure of gas in calf sleeve 6 by determining the gas flow into and out of manifold 42.

Pressure transducer 44 communicates pneumatically with the inflatable portion of calf sleeve 6 by means of tubing 16 and connector 15. As shown in FIGS. 1 and 2 pressure transducer 44 does not communicate pneumatically with valve manifold 42 except through calf sleeve 6. In this way, pressure transducer 44 directly and continuously measures the pressure of gas in the inflatable portion of calf sleeve 6, and is unaffected by variables including the flow resistance of tubing 14, the flow resistance of connector 13, the design of calf sleeve 6, the pneumatic volume of the inflatable portion of calf sleeve 6, and the snugness of application of calf sleeve 6 to the limb of patient 8. Pressure transducer 44 is electrically connected to an analog to digital converter (ADC) input of microprocessor 32 and generates a channel "B" sleeve pressure signal, the level of which is representative of the pressure of gas in calf sleeve 6.

Valve 38 communicates pneumatically with manifold 42 through tubing 46 to gas pressure reservoir 36. When activated valve 38 permits the flow of gas from reservoir 36 to manifold 42 and therefrom supplies pressurized gas through tubing 14 and connector 13 to the inflatable portion of calf sleeve 6. Valve 40 pneumatically connects manifold 42 to atmosphere, allowing a controlled reduction of pressure from calf sleeve 6.

As shown in FIG. 2, pneumatic pump 4 communicates pneumatically with reservoir 36 through tubing 50. Pump 48 acts to pressurize reservoir 36 in response to control signals from microprocessor 32. Reservoir pressure transducer 52 communicates pneumatically with reservoir 36 through tubing 54 and generates a reservoir pressure signal indicative of the pressure in reservoir 36. Pressure transducer 52 is electrically connected to an ADC input of microprocessor 32. In response to the reservoir pressure signal and a reservoir pressure reference signal, microprocessor 32 generates control signals for pump 48 and controls the pressure in reservoir 36 to maintain a pressure near the reference pressure represented by the reservoir reference pressure signal.

Multiple predetermined reference pressure waveforms suitable for application by foot sleeve 4, and multiple predetermined pressure waveforms suitable for application by calf sleeve 6, are stored within waveform register 56. In the preferred embodiment pressure waveforms are stored in waveform register 56 as a set of values describing the amplitude of pressure at all times within one complete waveform cycle time period. It will be apparent to those skilled in the art that certain reference pressure waveforms could alternatively be stored as series of coefficients for a mathematical equation describing the waveforms, or a scaling factor and a set of values representing a normalized waveform. Waveform register 56 responds to a waveform selection signal produced as described below. The level of the waveform selection signal determines which one of the stored predetermined reference pressure waveforms will be communicated to microprocessor 32.

Figure 3:
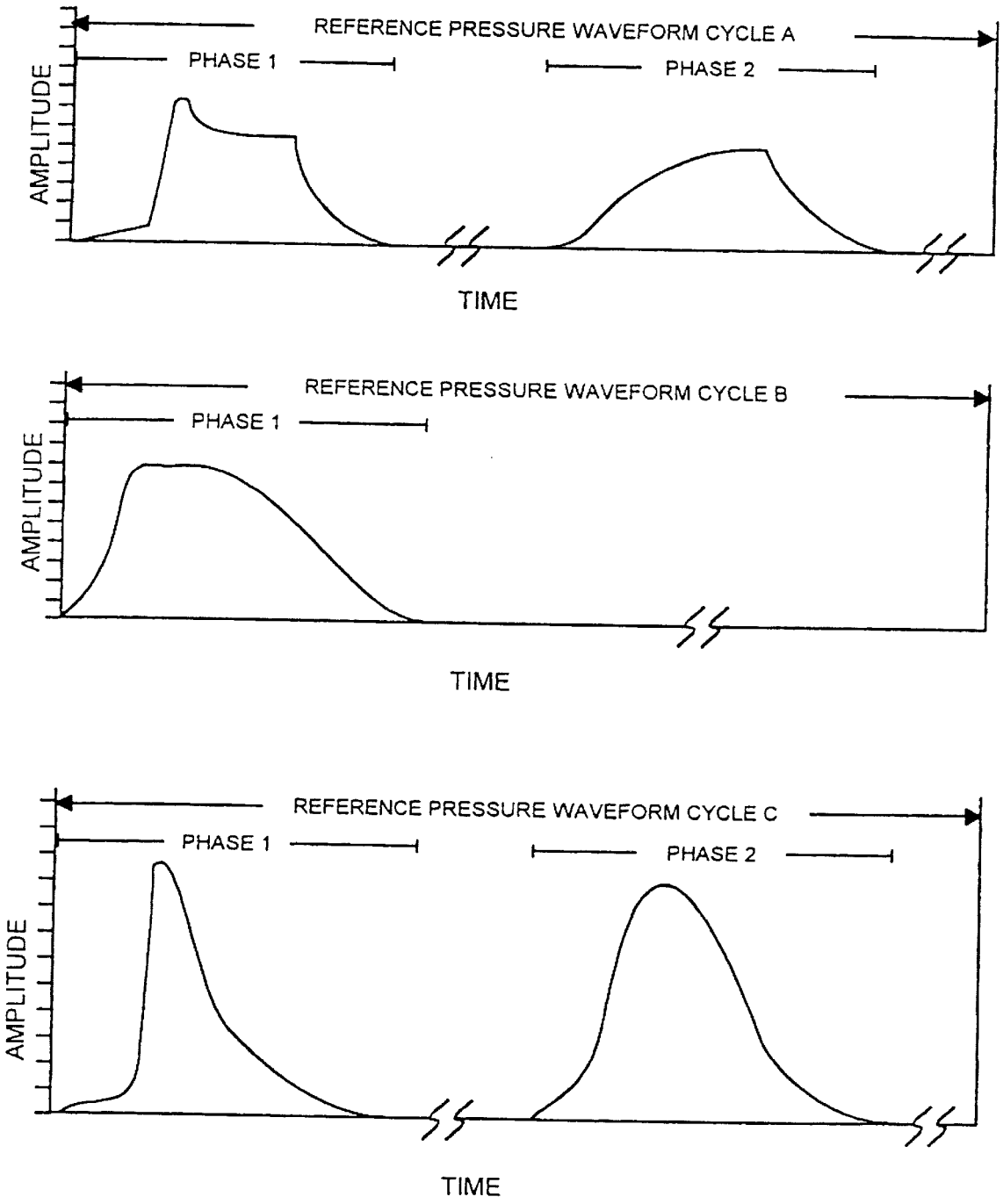
FIG. 3 are graphical representations of pressures applied to a region of a patient by the preferred embodiment.

FIG. 3 illustrates three examples of reference pressure waveforms, reference pressure waveforms A, B and C, which are maintained in waveform register 56. The waveforms over the complete cycle time period are shown. Each reference pressure waveform cycle has one or more discrete phases. In the context of the preferred embodiment, a phase of a reference pressure waveform is considered to be a variation in the amplitude of pressure during a time interval within the cycle time period having a shape adapted to produce a desired augmentation of the flow of venous blood proximally from a selected sleeve which is positioned on a limb near a desired location. Reference pressure waveforms A and C illustrate waveforms having two phases. Reference pressure waveform B illustrates a reference pressure waveform having a single phase. In the preferred embodiment the cycle time periods of reference pressure waveforms range between 50 and 200 seconds. The time intervals corresponding to phases of the reference pressure waveforms range between 2 and 20 seconds.

Reference pressure waveforms A and B shown in FIG. 3 are typical waveforms for application by calf sleeve 6. Reference pressure waveform C is a typical waveform for application by foot sleeve 4. Reference pressure waveforms A and C depicted in FIG. 3 have two different phases, indicated as phase 1 and phase 2 in FIG. 3. The variation in pressure amplitude of phase 1 of each reference pressure waveform A and C shown in FIG. 3 is adapted to augment the flow of venous blood into the limb proximal to the sleeve from the limb beneath the sleeve by increasing the maximum blood velocity during the phase 1 time interval of the reference pressure waveform. The variation in pressure amplitude of phase 2 of waveforms A and C is adapted to augment the flow of venous blood into the limb proximal to the sleeve from the limb beneath the sleeve by increasing the mean blood velocity during phase 2 time interval of the waveform. Pressure waveform cycle B is shown with a single phase that is adapted to augment both mean and maximum venous blood flow proximally into the limb from the region underlying the pressurizing sleeve.

Referring again to FIG. 2, microprocessor 32 operates, when directed by an operator of instrument 2 through manipulation of controls 22, to repetitively generate a selected reference pressure waveform in foot sleeve 4 connected to channel "A" of instrument 2. Microprocessor 32 continues to repetitively produce the desired pressure waveforms in foot sleeve 4 until an operator through manipulation of controls 22 directs microprocessor 32 to suspend the generation of pressure waveforms, or alternatively until microprocessor 32 suspends the generation of pressure waveforms in response to an alarm signal as described below.

To generate pressure waveforms in foot sleeve 4 connected to channel "A", microprocessor 32 first generates a channel "A" sleeve reference pressure waveform signal by: (a) retrieving from waveform register 56 a reference pressure waveform, as determined by the level of a channel "A" waveform selection signal; and (b) scaling the amplitude of the retrieved reference pressure waveform uniformly so that the amplitude of the scaled reference pressure waveform is equivalent to the desired amplitude of the channel "A" reference pressure waveform.

If subsequently desired by an operator, the level of the channel "A" waveform selection signal may be adjusted. Also, the amplitude of the channel "A" reference pressure waveform may be adapted by the operator of instrument 2 through manipulating controls 22. Alternatively, the level of the sleeve waveform selection signal and amplitude of the channel "A" reference pressure waveform may be automatically set by microprocessor 32 as a result of microprocessor 32 retrieving the values of previously stored parameters from configuration register 58 as described below. Microprocessor 32 may also, when instructed by an operator, automatically determine a new amplitude for the channel "A" reference pressure waveform as further described below.

The channel "A" sleeve reference pressure waveform signal is used by microprocessor 32, in combination with a channel "A" sleeve pressure signal generated by pressure transducer 26 and the reservoir pressure signal as described below, to maintain the pressure in the sleeve connected to channel "A" of instrument 2 near the pressure represented by the channel "A" sleeve reference pressure waveform signal by generating control signals for valves 28 and valve 30.

Microprocessor 32 subtracts the pressures represented by the levels of the channel "A" reference pressure waveform signal and the channel "A" sleeve pressure signal. The difference in pressure between the sleeve pressure and the reference waveform pressure is used by microprocessor 32 along with the pressure represented by the level of the reservoir pressure signal to calculate levels of control signals for valves 28 and 30. Valves 28 and 30 respond to the control signals to increase, decrease or maintain the pressure in foot sleeve 4 connected to channel "A" such that the pressure within foot sleeve 4 at the time is maintained near the pressure represented by the level of the channel "A" reference pressure waveform signal.

To alert the operator when the pressures being generated in foot sleeve 4 are not within a desired limit of the pressures indicated by the channel "A" reference pressure waveform signal, microprocessor 32 generates alarm signals. Microprocessor 32 first compares the pressure in foot sleeve 4 to the pressure indicated by the level of the channel "A" reference pressure waveform signal. If the pressure in foot sleeve 4 exceeds the reference pressure by a pre-set limit of 10 mmHg, microprocessor 32 generates an alarm signal indicating over-pressurization of the sleeve connected to channel "A". If the pressure in foot sleeve 4 is less than the reference pressure signal by a pre-set limit of 10 mmHg, microprocessor 32 generates an alarm signal indicating under-pressurization of the sleeve connected to channel "A".

Microprocessor 32 also maintains a therapy duration counter to track the actual number of pressure waveforms that have been generated in foot sleeve 4 by channel "A" and the length of time that these pressure waveforms have been produced. Microprocessor 32 compares this actual channel "A" sleeve therapy duration to a channel "A" sleeve therapy duration time limit, and if the actual therapy duration time exceeds the therapy duration time limit, microprocessor 32 generates an alarm signal indicating that the therapy duration time limit for the channel "A" sleeve has been exceeded.

To generate pressure waveforms in calf sleeve 6 connected to channel "B" of instrument 2, microprocessor 32 operates in an equivalent manner to the operation of channel "A" as described above. Reference pressure waveforms, alarm signals and valve control signals are produced independently of those produced for channel "A".

When instructed by an operator of instrument 2 through manipulation of controls 22, microprocessor 32 will initiate the sequential generation of pressure waveforms in foot sleeve 4 and calf sleeve 6 connected to channels "A" and "B". The timing of the sequential generation of pressure waveforms in sleeves 4 and 6 may be selected by the operator to be: a) the initiation of a pressure waveform cycle by channel "B" at a predetermined time interval following the initiation of a pressure waveform cycle by channel "A"; or b) the initiation of a pressure waveform cycle by channel "B" upon the pressure within foot sleeve 4 connected to channel "A" exceeding a predetermined pressure level; or c) the initiation of a pressure waveform cycle by channel "B" upon slope of the pressure waveform within foot sleeve 4 connected to channel "A" exceeding a predetermined slope threshold.

Venous blood flow sensor 18 is located on a portion of either the right or the left limb, proximal to either foot sleeve 4 or calf sleeve 6 to sense the velocity of venous blood flowing in a vein located beneath flow sensor 18. The velocity of blood flow in the vein proximal to the sleeve is augmented as determined by the shape of pressure waveforms generated in the sleeve and applied to the limb beneath the sleeve. FIG. 1 illustrates a typical location for the application of sensor 18 to the lower limb. Sensor 18 operates using Doppler ultrasound to generate a venous blood flow signal indicative of the velocity of blood flow in a vein beneath sensor 18, which is processed by sensor interface 60 and communicated to microprocessor 32, as depicted in FIG. 2.

During the generation of a pressure waveform in a sleeve connected to either channel "A" or "B" of instrument 2, microprocessor 32 analyzes the venous blood flow signal from sensor 18 to determine, for each phase of the pressure waveform, the peak venous blood flow velocity and the mean time-averaged venous blood velocity resulting from the application of the pressure waveform. The magnitude of these velocities are indicative of the effectiveness of the therapy that is delivered to a patient by the preferred embodiment. Although a Doppler ultrasound sensor has been incorporated into the preferred embodiment, other sensors may alternately be employed using photoplethysmography, oximetry, de-oximetry or impedance plethysmography to provide an indication of augmentation of venous blood flow in one or both limbs simultaneously.

To assist the operator of instrument 2 in adapting the amplitude of a reference pressure waveform, microprocessor 32, as instructed by an operator of instrument 2 through manipulation of controls 22, may automatically adapt amplitude of the selected reference pressure waveform for channels "A" and "B" to increase the peak and time averaged venous blood flow velocities, as selected. This is further described in the software description given below.

Configuration register 58 shown in FIG. 2 is comprised of non-volatile memory and operates in conjunction with microprocessor 32 as described below. Configuration register 58 contains the values of previously recorded parameters representing reference pressure waveform selections, amplitudes of reference pressure waveforms and therapy time duration alarm limits for use by microprocessor 32 as described below, and retains the recorded values of these parameters indefinitely in the absence of electrical power supplied to configuration register 58 and in the absence or interruption of electrical power from power supply 62 required for the normal operation of instrument 2. The values of the parameters representing waveform selections, amplitudes of reference pressure waveforms and therapy time duration limits initially recorded in configuration register 58 are given in the table below:

| | | Reference Waveform Selection | Amplitude | Therapy Duration Time Limit |
|---|---|---|---|---|
| Channel "A" | Foot | 3 | 180 mmHg | 8 Hrs |
| | Calf | 1 | 50 mmHg | 8 Hrs |
| Channel "B" | Foot | 3 | 180 mmHg | 8 Hrs |
| | Calf | 1 | 50 mmHg | 8 Hrs |

Microprocessor 32 communicates with configuration register 58 to record and retrieve levels of the configuration parameters recorded in configuration register 58 as also described below.

Real time clock 64 shown in FIG. 2 maintains the current time and date, and includes a battery as an alternate power source such that clock operation continues during any interruption in the supply of electrical power from power supply 62 required for the normal operation of instrument 2. Microprocessor 32 communicates with real time clock 64 for both reading and setting the current time and date.

Therapy register 66 shown in FIG. 2, records "events" related to the pressure waveforms generated in sleeves connected to channels "A" and "B" of instrument 2, and thereby related to the therapy delivered to a patient by the preferred embodiment. "Events" are defined in the preferred embodiment to include: (a) actions by the operator to initiate the generation of pressure waveforms in a sleeve, to suspend the generation of pressure waveforms in a sleeve, to select a reference pressure waveform for generation in a sleeve, to adapt the amplitude of a pressure of a waveform, or to adjust the therapy time duration alarm limits; (b) alarm events resulting from microprocessor 32 generating alarm signals as described above; and (c) events associated with determining an amplitude for a reference pressure waveform automatically as described below.

Microprocessor 32 communicates with therapy register 66 to record events as they occur. Microprocessor 32 records an event by communicating to therapy register 66: the time of the event as read from real time clock 64, and a value identifying which one of a specified set of events occurred as determined by microprocessor 32. Also, if the event relates to channel "A" of instrument 2, therapy register 66 records the values at the time of the event of the following parameters: the channel "A" waveform selection signal, the channel "A" reference pressure waveform amplitude, the channel "A" sleeve pressure signal, and the channel "A" sleeve therapy duration. Alternatively, if the event relates to channel "B" of instrument 2, therapy register 66 records the values at the time of the event of the following parameters: the channel "B" waveform selection signal, the channel "B" reference pressure waveform amplitude, the channel "B" sleeve pressure signal, and the channel "B" sleeve therapy duration.

Microprocessor 32, when directed by an operator of instrument 2 through manipulation of controls 22, subsequently displays, prints or transfers to an external computer the values associated with events stored in therapy register 66. Therapy register 66 retains information indefinitely in the absence or interruption of electrical power from power supply 62 required for the normal operation of therapy register 66.

Safety circuit 68 acts to prevent abnormal valve actuations resulting from: failure of the electronic circuitry associated with controlling valves 28, 30, 38 and 40; failure in microprocessor 32; or software error. Safety circuit 68 operates independently of microprocessor 32 such that safety circuit 68 continues to operate normally during a malfunction or complete failure of microprocessor 32. An abnormal valve actuation may cause abnormal pressure waveforms to be applied to a patient, resulting in injury or unintended therapy. Upon detecting an abnormal valve actuation safety circuit 68, will cause: a) the supply of electrical power to valves 28, 30, 38 and 40 to be disconnected; b) an audio tone to be emitted by loud speaker 70; c) a message to be displayed upon display panel 20; and d) the operation of microprocessor 32 to be suspended. When valves 30 and 40 are disconnected from electrical power sleeves connected to channel "A" and "B" will be allowed to vent to atmosphere as valves 30 and 40 are normally open valves. Similarly, when valves 28 and 38 are disconnected from electrical power, pressurized gas in reservoir 36 is prevented from flowing to sleeves connected to channels "A" and "B" as valves 28 and 38 are normally closed valves.

To detect abnormal valve actuations safety circuit 68 monitors the electrical current supplied to each of valves 28, 30, 38, and 40. The amount of current supplied to a valve is indicative of the state of the valve, actuated or deactuated. Safety circuit 68 receives from microprocessor 32 mode signals indicative of: the mode of operation of each channel, defined to be either an "active" mode during which pressure waveforms are being generated, or an "inactive" mode during which pressure waveforms are not being generated. Also, safety circuit 68 receives from microprocessor 32 the channel "A" and "B" reference pressure waveform signals indicative of the current sleeve pressure levels.

The table below summarizes the abnormal combinations of valve actuations which are detected by safety circuit 68 for channel "A", equivalent abnormal actuations are also detected by safety circuit 68 for channel "B".

| Channel "A" mode | Channel "A" reference pressure waveform level | Valve 28 (normally closed) | Valve 30 (normally open) |
|---|---|---|---|
| Inactive | don't care | Actuated | De-actuated |
| Inactive | don't care | Actuated | Actuated |
| Inactive | don't care | De-actuated | Actuated |
| Active | <2 mmHg | Actuated | De-actuated |
| Active | <2 mmHg | Actuated | Actuated |
| Active | <2 mmHg | De-actuated | Actuated |
| Active | >= 2 mmHg | Actuated | Actuated |

Referring to FIG. 2, and as described above operator input is by means of controls 22. Signals from controls 22, arising from contact closures of the switches that comprise controls 22 are communicated to microprocessor 32.

Microprocessor 32 will, in response to generated alarm signals, alert the operator by text and graphic messages shown on display panel 20 and by audio tones. Electrical signals having different frequencies to specify different alarm signals and conditions are produced by microprocessor 32 and converted to audible sound by loud speaker 70 shown in FIG. 2.

Power supply 62 provides regulated DC power for the normal operation of all electronic and electrical components within instrument 2.

II. Software

FIGS. 4, 5, 6 and 7, are software flow charts depicting sequences of operations which microprocessor 32 is programmed to carry out in the preferred embodiment of the invention. In order to simplify the discussion of the software, a detailed description of each software subroutine and of the control signals which the software produces to actuate the hardware described above is not provided. The flow charts shown and described below have been selected to enable those skilled in the art to appreciate the invention. Functions or steps carried out by the software are described below and related to the flow charts via parenthetical reference numerals in the text.

Figure 4:
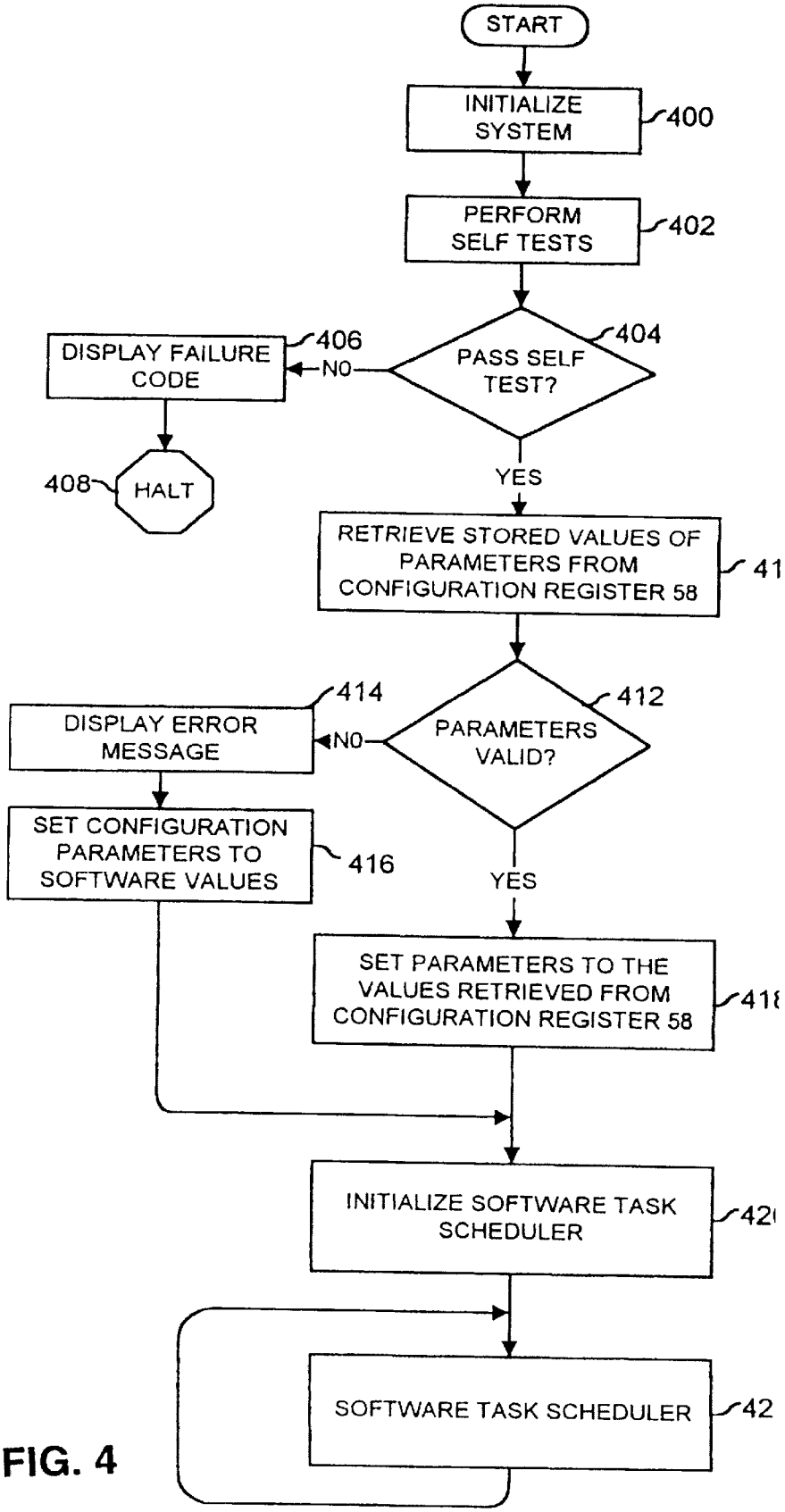
FIGS. 4, 5, 6 and 7 are software flow charts depicting sequences of operations carried out in the preferred embodiment.
Figure 5:
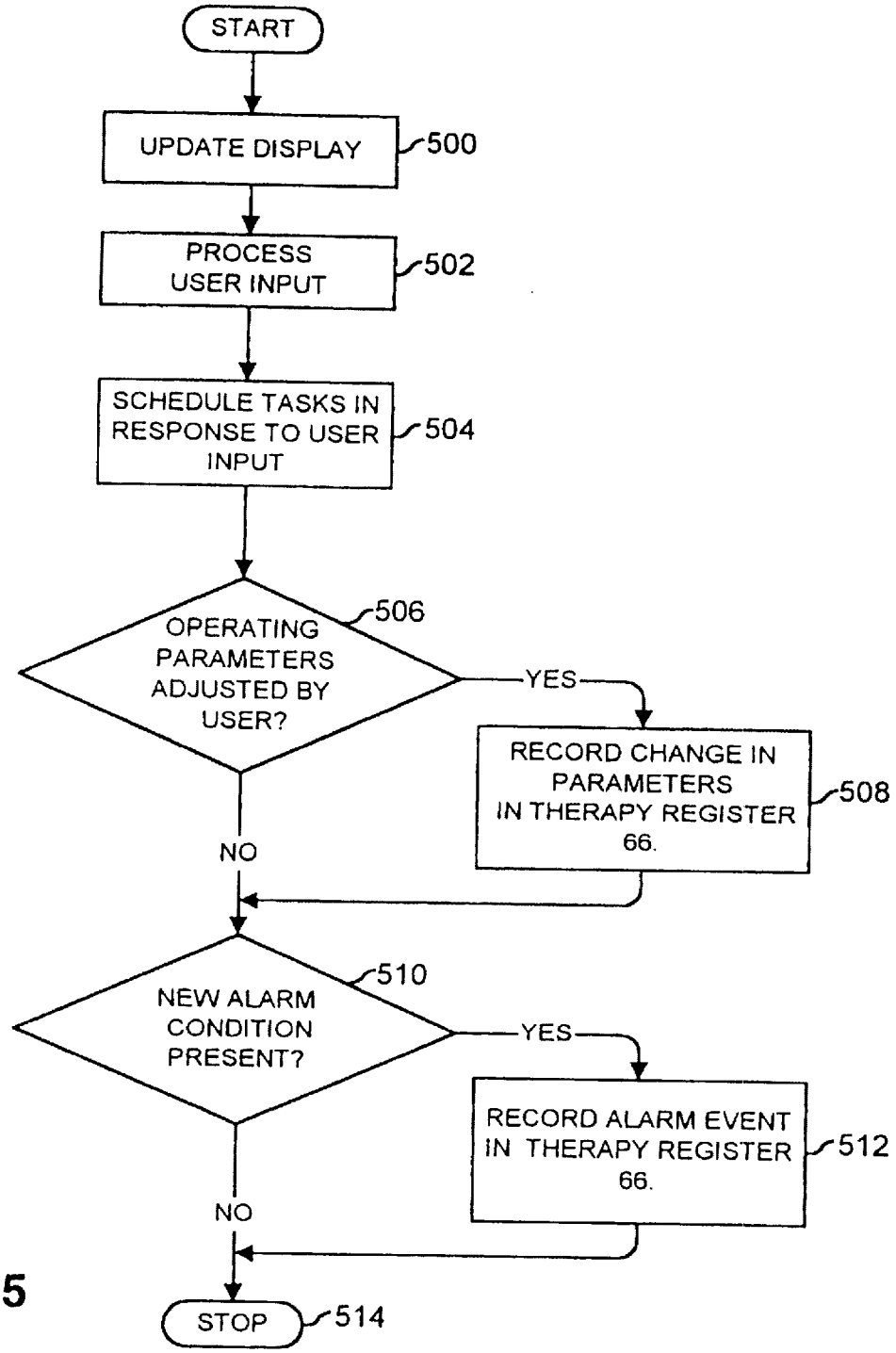
Figure 6:
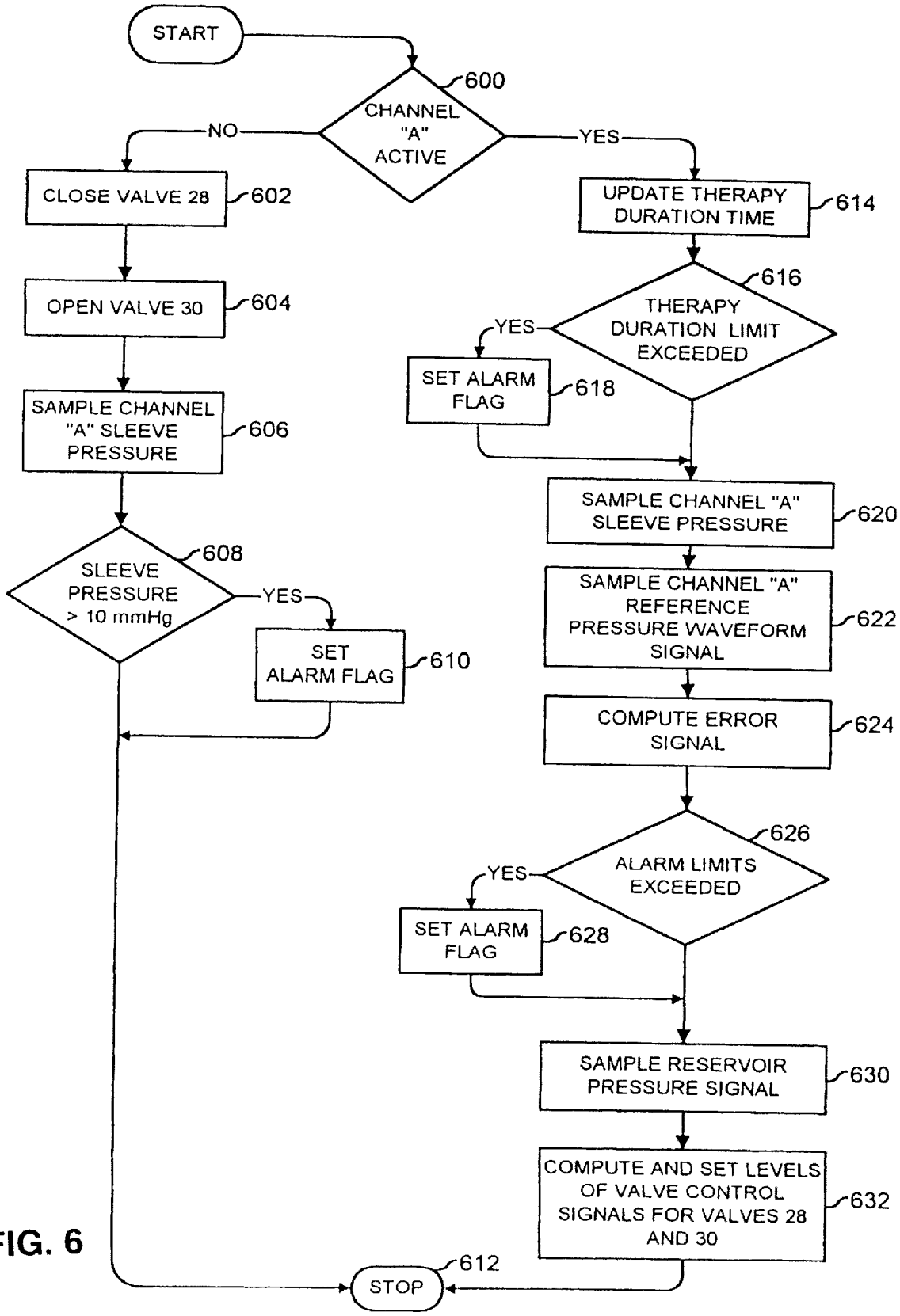
Figure 7:
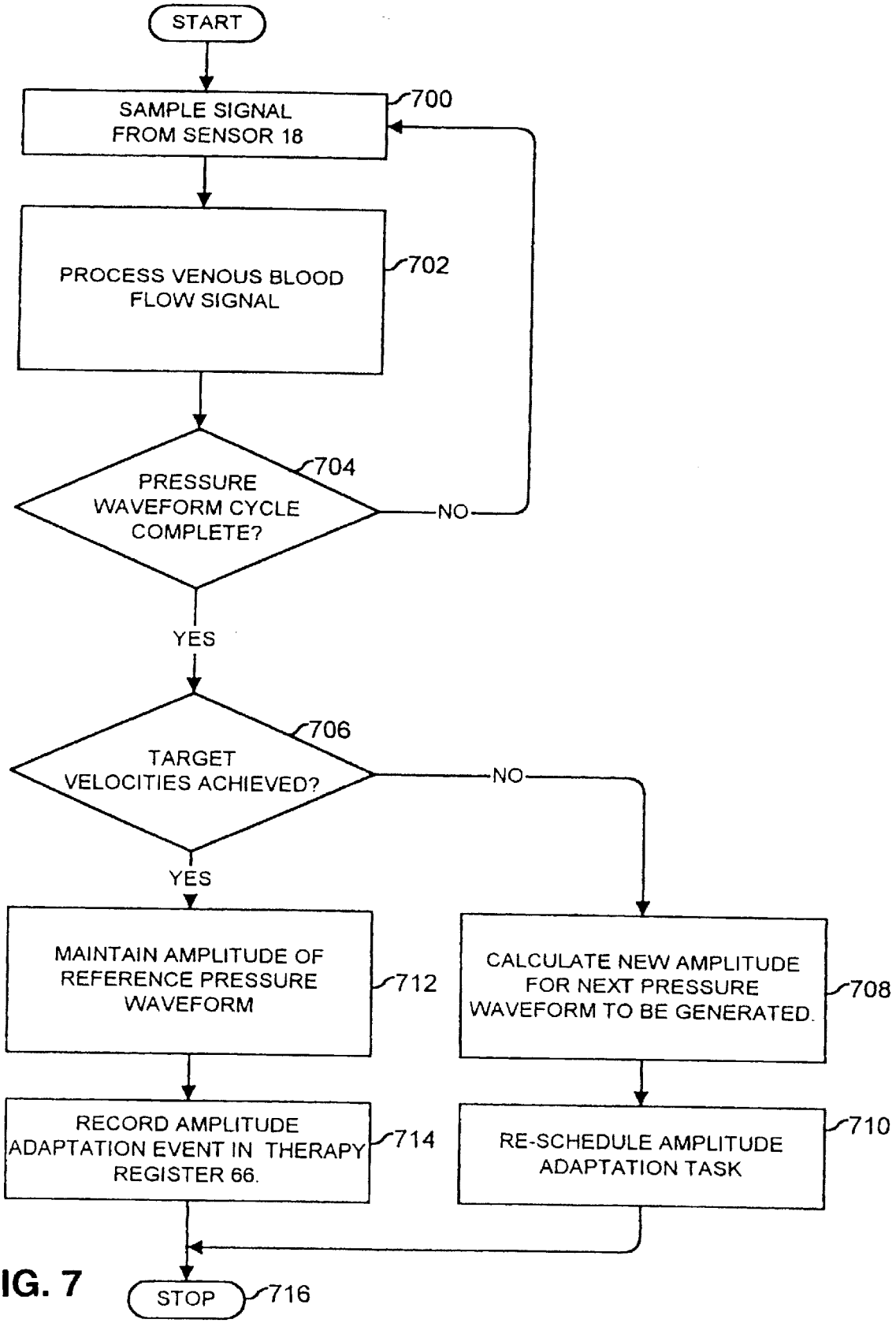

FIG. 4 shows the initialization operations carried out by the main program. FIG. 5 shows a software task associated with processing input from an operator and updating therapy register 66. FIG. 6 shows a software task for controlling the channel "A". FIG. 7 shows a software task associated with the automatic determination of the amplitude of a reference pressure waveform.

FIG. 4 shows the initialization operations carried out by the system software. The program commences (400) when power is supplied to microprocessor 32 by initializing microprocessor 32 for operation with the memory system and circuitry and hardware of the preferred embodiment. Control is then passed to a self-test subroutine (402). The self-test subroutine displays a "SELF TEST" message on display panel 20 and performs a series of diagnostic tests to ensure proper operation of microprocessor 32, its associated hardware and safety circuit 68. Should any diagnostic test fail (404), an error code is displayed on display panel 20 (406) and further operation of the system is halted (408); if no errors are detected, control is returned to the main program.

As can be seen in FIG. 4, after the "self-test" has been completed successfully, control is next passed to a subroutine (410) which retrieves from configuration register 58 the values of previously recorded configuration parameters. The configuration parameters for each channel are: a reference pressure waveform selection, reference pressure waveform amplitude and therapy time duration alarm limit for both calf and foot sleeves, as described above.

Upon completion, this subroutine returns control to the main program. Control is next passed to a subroutine (412) which tests the values of the retrieved configuration parameters for validity by: (1) calculating a checksum for the retrieved values of the parameters and comparing it to a checksum previously calculated and recorded in configuration register 58; (2) testing each retrieved parameter value to ensure it is within pre-defined allowable limits. If any of the values of the retrieved parameters are found to be invalid an error message is displayed on display panel 20 (414), and configuration parameters are set to default values defined in software (416). If the retrieved parameters are valid, the reference pressure waveform selections, reference pressures waveform amplitudes and therapy time duration alarm limits for both calf and foot sleeves are set to the previously recorded values of the configuration parameters (418).

Next, a software task manager is initialized (420). The software task manager executes at predetermined intervals software subroutines which control the operation of instrument 2. Software tasks may be scheduled to execute at regularly occurring intervals. For example the subroutine shown in FIG. 6 and described below executes every 2 milliseconds. Other software tasks execute only once each time they are scheduled. The task manager (422) continues to execute scheduled subroutines until one of the following occurrences: a) power is no longer supplied to microprocessor 32; b) the operation of microprocessor 32 has been interrupted by safety circuit 68 in response to a detected fault condition; or c) the operation of microprocessor 32 has been halted by software in response to the software detecting an error condition.

FIG. 5 shows a flowchart of the software task associated with updating display 20 and processing input from an operator. This task is executed at regular predetermined intervals. Control is first passed to a subroutine that updates the menus of commands and values of displayed parameters shown on display 20 (500). The menus of commands and parameters shown on display 20 are appropriate to the current operating state of instrument 2 as determined and set by other software subroutines.

Control is next passed to a subroutine (502) which processes the input from controls 22. In response to operator input by means of controls 22 other software tasks may be scheduled and initiated (504). For example, if the operator has selected a menu command to adapt the amplitude of the channel "A" reference pressure waveform so that the amplitude of the channel "A" reference pressure waveform is equivalent to a desired amplitude, an appropriate software task is scheduled to effect the scaling of the channel "A" reference pressure waveform.

Control is then passes to a subroutine (506) which determines if the operating parameters (reference pressure waveform selections, amplitudes of reference pressure waveforms, therapy duration limits, initiation or suspension of the application of pressure waveforms) of instrument 2 which affect the therapy delivered to a patient have been adjusted by an operator of instrument 2. Current values of operating parameters are compared to previous values of operating parameters. If the current value of any one or more parameters differs from its previously set value control is passed to a subroutine (508) for recording events in therapy register 66. This subroutine (508) records an event by storing the following in therapy register 66: the time of the event as read from real time clock 64; and a value identifying which one or more of a specified set of events occurred as determined by subroutine (506). Also, if the event relates to channel "A" of instrument 2, the values of the following parameters at the time of the event are also stored in therapy register 66: channel "A" waveform selection signal, amplitude of the channel "A" reference pressure waveform, channel "A" sleeve pressure signal and the channel "A" sleeve therapy duration. Alternatively if the event relates to channel "B" of instrument 2, the values of the following parameters at the time of the event are stored in therapy register 66: channel "B" waveform selection signal, amplitude of the channel "B" reference pressure waveform, channel "B" sleeve pressure signal and the channel "B" sleeve therapy duration.

As shown in FIG. 5 control is next passed to a subroutine (510) which compares the current alarm conditions to previous alarm conditions. If any one or more alarm conditions exist which did not previously exist, control is passed to a subroutine (512) for recording the alarm event in therapy register 66. Subroutine (512) records an alarm event by storing in therapy register 66 the time of the event as read from real time clock 64; a value identifying which one or more of a specified set of alarm events occurred as determined by subroutine (510). Also, if the alarm event relates to channel "A" of instrument 2, the values of the following parameters at the time of the event are also stored in therapy register 66: channel "A" waveform selection signal, amplitude of the channel "A" reference pressure waveform, channel "A" sleeve pressure signal and the channel "A" sleeve therapy duration. Alternatively if the event relates to channel "B" of instrument 2, the values of the following parameters at the time of the event are stored in therapy register 66: channel "B" waveform selection signal, amplitude of the channel "B" reference pressure waveform, channel "B" sleeve pressure signal and the channel "B" sleeve therapy duration. The software task shown in FIG. 5 then terminates (514).

FIG. 6 depicts a software task associated with controlling channel "A" of instrument 2. A similar software task exists for controlling channel "B", but for simplicity only the task associated with channel "A" will be described. The software task shown in FIG. 6 is scheduled to execute continuously once every two milliseconds. As shown in FIG. 6, if channel "A" is not currently generating pressure waveforms (600) in foot sleeve 4 the valve control signal for valve 28 is set to a level that ensures valve 28 remains closed (602). The valve control signal for valve 30 is set to a level that ensures valve 30 remains open (604). Opening valve 30 vents any gas in foot sleeve 4 connected to channel "A" to atmosphere, and closing valve 28 prevents gas from flowing from reservoir 36 to foot sleeve 4 connected to channel "A".

The channel "A" sleeve pressure signal is then sampled (606). If the pressure in foot sleeve 4 connected to channel "A" is above a predetermined threshold of 10 mmHg (608), an alarm flag is set (610) to indicate that the sleeve connected to channel "A" is pressurized at a time when it should not be pressurized. The software task associated with controlling channel "A" then terminates (612).

As shown in FIG. 6, if channel "A" is currently generating pressure waveforms (600) in foot sleeve 4, control is passed to a subroutine which updates the therapy duration timer (614) for channel "A". Control next passes to a subroutine (616) which compares the current therapy duration time to the therapy time duration limit for channel "A". If the therapy time duration limit has been exceeded, an alarm flag is set (618) to indicate that the therapy time duration limit for channel "A" has been exceeded.

The software task continues by sampling the value of the channel "A" sleeve pressure signal (620). Control is then passed to a subroutine (622) which samples the channel "A" reference pressure waveform signal. The value of the sample obtained from the reference pressure waveform signal is representative of the desired sleeve pressure at the instant of time when the subroutine executes. An error signal is computed (624) by calculating the difference between the pressure indicated by the value of the channel "A" sleeve pressure signal and the value of the sample of the channel "A" reference pressure waveform signal. Control is passed to a subroutine (626) that compares the error signal to predetermined limits and sets an alarm flag (628) if the limits have been exceeded. Next, the signal from reservoir pressure transducer 52 is sampled (630). Control then passes to a subroutine (632) which calculates levels for the control signals for valve 28 and valve 30. The subroutine (632) uses the current levels of the error signal and reservoir pressure signal, as well as previously stored levels of these signals, to compute new levels for the valve 28 and 30 control signals. When the calculation subroutine (632) completes, the software task shown in FIG. 6 terminates (612).

As described above an operator of instrument 2 may elect to adapt the amplitude of a reference pressure waveform generated in a sleeve connected to either channel "A" or "B" automatically. The software task depicted in FIG. 7 is associated with the automatic adaptation of the amplitude of a reference pressure waveform. The task begins by sampling the venous blood flow signal from sensor 18 (700). Next control is passed to a subroutine (702) which processes the venous blood flow signal from venous blood flow sensor 18. This subroutine (702) calculates the mean time-averaged venous blood flow velocity and the peak venous blood flow velocity for each phase of the currently generated pressure waveform in the sleeve. The sampling and calculation continues until the reference pressure waveform cycle time period has elapsed (704). At completion of the generation of a pressure waveform, control is passed to a subroutine (706) which compares the velocities of mean time-averaged venous blood flow and peak venous blood flow for each phase of the recently generated pressure waveform to predefined target velocities. If the target velocities for mean time-average venous blood flow and peak venous blood flow have not been achieved control is passed to a subroutine (708) which calculates a new amplitude for the next pressure waveform to be generated in the sleeve. Control next passes to a subroutine (710) that re-schedules the amplitude adaptation task shown in FIG. 7 to execute again during the generation of the next pressure waveform. The amplitude adaptation task then terminates (716).

If the comparison of venous blood flow velocities performed in subroutine (706) indicates that the predetermined target velocities have been met, control is passed to a subroutine (712) which causes the amplitude of the reference pressure waveform to be maintained at its current level.

Control is next passed to a subroutine (714) which records in therapy register 66 an amplitude adaptation event by storing in therapy register 66 the time of the event as read from real time clock 64 and a value identifying that an amplitude adaptation event occurred. Also, if the event relates to channel "A" of instrument 2, the values of the following parameters at the time of the event are also stored in therapy register 66: channel "A" waveform selection signal, amplitude of the channel "A" reference pressure waveform, channel "A" sleeve pressure signal and the channel "A" sleeve therapy duration. Alternatively if the event relates to channel "B" of instrument 2, the values of the following parameters at the time of the event are stored in therapy register 66: channel "B" waveform selection signal, amplitude of the channel "B" reference pressure waveform, channel "B" sleeve pressure signal and the channel "B" sleeve therapy duration. The software task shown in FIG. 7 then terminates (716).

III. Sleeves

Figure 8:
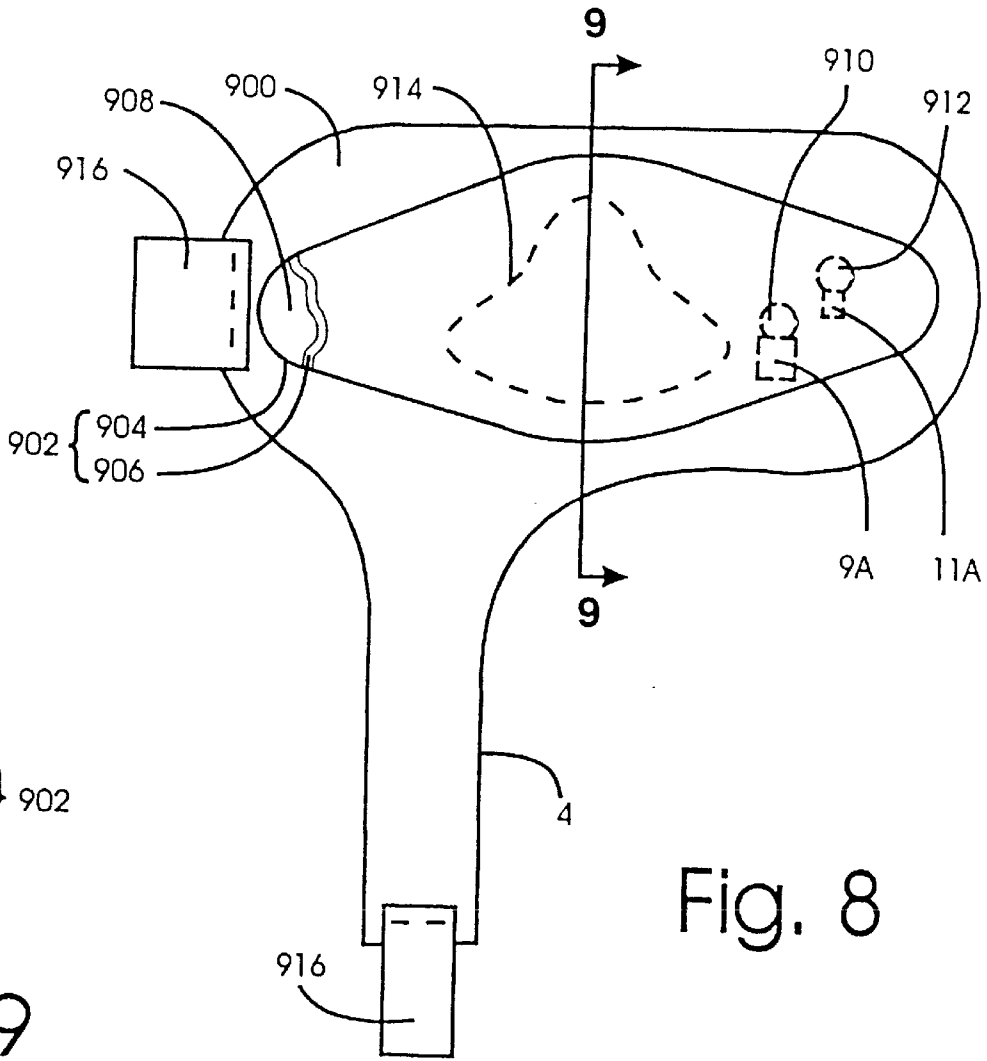
FIGS. 8 and 9 are pictorial representations of a sleeve for applying pressures to a patients foot.

FIG. 8 is a plan view to illustrate details of foot sleeve 4. Foot sleeve 4 is manufactured in a single size designed to accommodate 95% of normal adult feet. Foot sleeve 4 includes exterior layer 900 which forms a non-inflating portion, and bladder assembly 902 which forms an inflating portion. Exterior layer 900 is fabricated from a synthetic cloth material and has an outer and inner surface which allows engagement with a Velcro™ hook material.

Figure 9:
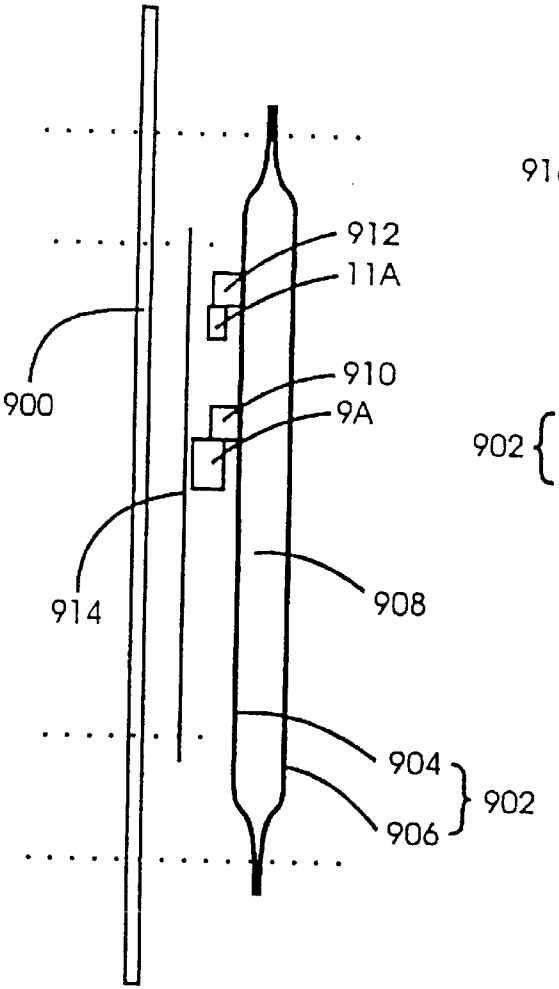

As shown in plan view FIG. 8 and cross sectional view FIG. 9, bladder assembly 902 contains layer 904 and layer 906. Layers 904 and 906 are fabricated from a flexible gas-impermeable thermoplastic polyvinylchloride sheet material permanently bonded together to form inflatable bladder 908. The flexibility of this gas-impermeable polyvinylchloride sheet material is predetermined and substantially inextensible when bladder 908 is pressurized up to 300 mmHg.

Ports 910 and 912 are thermoplastic right-angle flanges. Port 910, in combination with tubing 10 and connector 9, provides a pneumatic passageway suitable for increasing or decreasing the gas pressure within bladder 908 of foot sleeve 4. Port 912, in combination with pressure transducer 26, tubing 12 and connector 11, is used in the preferred embodiment to enable direct, accurate and continuous measurement of gas pressure in foot sleeve 4 by transducer 26 in a manner unaffected by variables such as the flow resistance of tubing 10, the flow resistance of connector 9, the design of foot sleeve 4, the pneumatic volume of the inflatable portion of foot sleeve 4 and the snugness of application of foot sleeve 4. Alternatively, it will be appreciated that direct, accurate and continuous measurement of pneumatic pressure within bladder 908 of foot sleeve 4 could be accomplished by embedding an electronic pressure transducer within bladder 908.

Referring to FIG. 8 and FIG. 9, stiffener 914 located between exterior layer 900 and bladder assembly 902, is permanently attached to layer 900. The shape of stiffener 914 is pre-determined being of sufficient width and length to cover the medial planter vein of the foot. Stiffener 914 fabricated from a thermoplastic sheet material has a predetermined thickness and rigidity to direct the inflated portion of bladder 908 above stiffener 914 toward the limb producing the desired applied pressure waveform when bladder 908 is inflated.

As shown in FIG. 8, fasteners 916 attached to layer 900 consist of rectangular sections of Velcro™ hook material which removably engage with the cloth surface of layer 900 ensuring that foot sleeve 4 remains secured to a limb when bladder 908 is inflated.

Foot sleeve 4 is manufactured by die cutting layer 900 from the desired synthetic cloth material. Two holes are cut into layer 908 providing access for ports 910 and 912 allowing them to protrude through layer 900 when bladder assembly 902 is secured in place. Stiffener 914 die cut from a thermoplastic sheet material into a predetermined shape is then permanently heat sealed to layer 900 using Radio Frequency (RF) sealing equipment. Fasteners 916 are sewn to layer 900 such that the hooks of fasteners 916 face away from layer 900.

Fabrication of bladder assembly 902 begins by die cutting layers 904 and 906 from a flexible polyvinylchloride sheet material. Two holes are die cut into layer 904 allowing ports 910 and 912 to be inserted into position and bonded in place using RF sealing equipment. With ports 910 and 912 facing away from layer 906, layers 904 and 906 are heat sealed together forming bladder 908. With fasteners 916 facing ports 910 and 912 of bladder assembly 902, ports 910 and 912 are inserted into the holes in layer 900 such that ports 910 and 912 protrude through layer 900. Manufacturing of foot sleeve 4 is completed by permanently fastening bladder assembly 902 to layer 900 using RF sealing equipment and by inserting pneumatic connectors 9A and 11A into the opening of ports 910 and 912 respectively.

FIG. 1 illustrates foot sleeve 4 communicating pneumatically with instrument 2 by means of pneumatic connectors 9 and 11. As described above connector 9A is physically incompatible with connector 11B and does not mate with connector 11B. Connector 11A is physically incompatible with connector 9B and does not mate with connector 9B.

Figure 10:
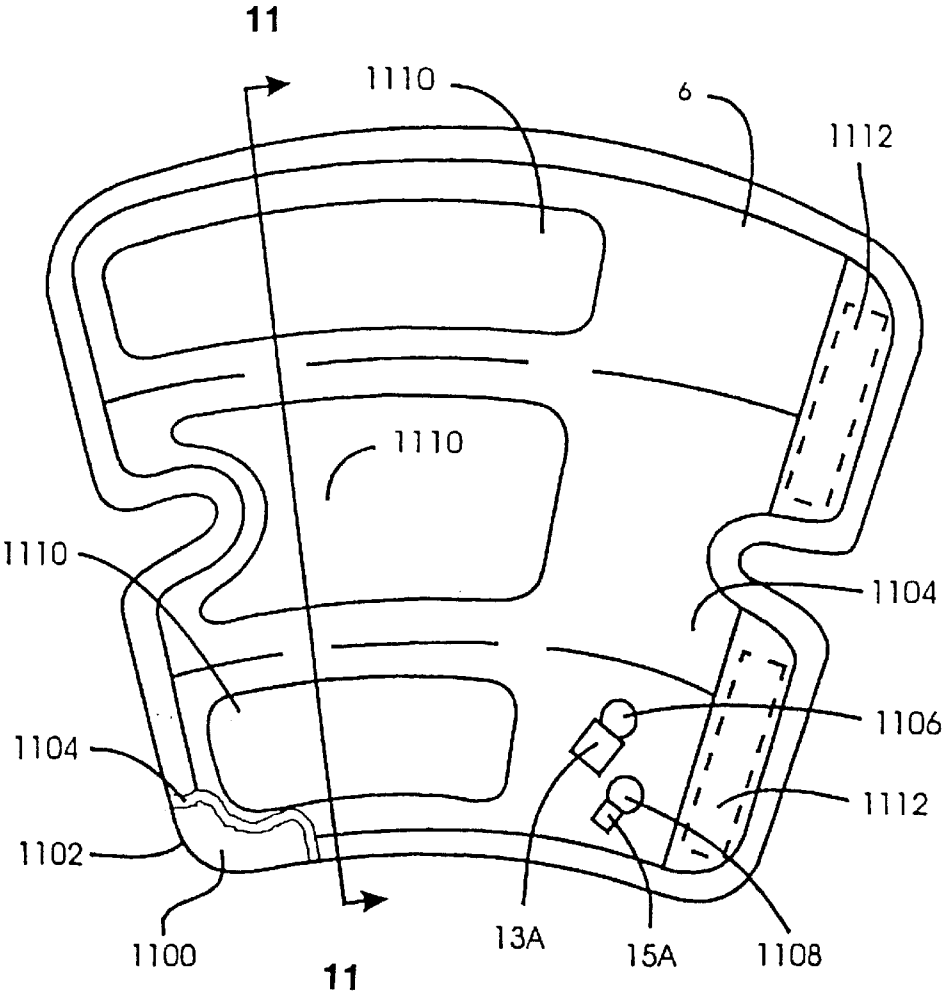
FIGS. 10 and 11 are pictorial representations of sleeve for applying pressures to a patients calf.
Figure 11:
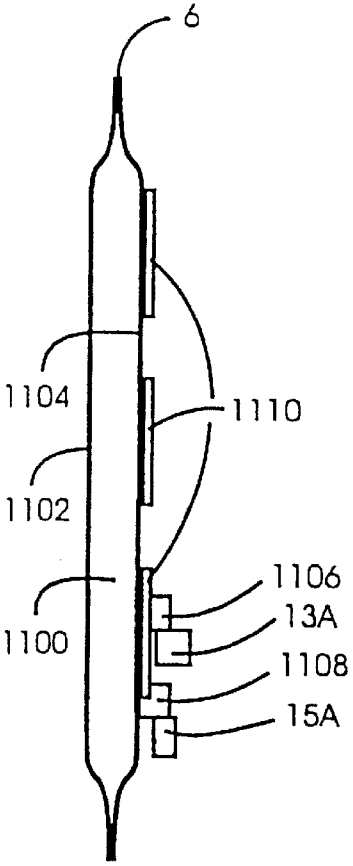

FIG. 10 is a plan view to illustrate details of calf sleeve 6. Calf sleeve 6 is manufactured in a single size designed to conform to a variety of calf shapes and sizes accommodating 95% of the normal adult population. As illustrated in plan view FIG. 10 and cross sectional view FIG. 11, calf sleeve 6 includes bladder 1100 which forms an inflatable portion surrounded by and an non-inflatable portion. Bladder 1100 of calf sleeve 6 is formed by permanently bonded together layers 1102 and 1104 using Radio Frequency (RF) sealing equipment.

Layers 1102 and 1104 are fabricated from a flexible gas-impermeable thermoplastic polyvinylchloride sheet material. The rigidity and thickness of this gas-impermeable sheet material is predetermined allowing layers 1102 and 1104 to be substantially inextensible when bladder 1100 is pressurized up to 60 mmHg.

Ports 1106 and 1108 are thermoplastic right-angle flanges. Port 1106, in combination with tubing 14 and connector 13, provides a pneumatic passageway suitable for increasing or decreasing the gas pressure within bladder 1100 of calf sleeve 6. Port 1108, in combination with pressure transducer 44, tubing 16 and connector 15, is used in the preferred embodiment to enable direct, accurate and continuous measurement of gas pressure in calf sleeve 6 by transducer 44 in a manner unaffected by variables such as the flow resistance of tubing 14, the flow resistance of connector 13, the design of calf sleeve 6, the pneumatic volume of the inflatable portion of calf sleeve 6 and the snugness of application of calf sleeve 6. Alternatively, it will be appreciated that direct, accurate and continuous measurement of pneumatic pressure within bladder 1100 of calf sleeve 6 could be accomplished by embedding an electronic pressure transducer within bladder 1100.

Shown in FIG. 10, Velcro™ loop fasteners 1110 and Velcro™ hook fasteners 1112 removably engage each other allowing application and removal of calf sleeve 6. Fasteners 1110 and 1112 ensure that calf sleeve 6 remains secured a limb when bladder 1100 is inflated. Velcro™ loop fasteners 1110 and Velcro™ hook fasteners 1112 have a thermoplastic coating on one side allowing loop fasteners 1110 to be bonded to the outer surface of thermoplastic layer 1104 and hook fasteners 1112 to be bonded to the outer surface of thermoplastic layer 1102.

Calf Sleeve 6 is manufactured by die cutting layers 1102 and 1104 from a polyvinylchloride thermoplastic sheet material. Two holes are die cut into layer 1104 providing access for ports 1106 and 1108. Ports 1106 and 1108 are inserted through the holes in layer 1104 and bonded to layer 1104 using RF sealing equipment. Velcro™ loop fasteners 1110 are permanently RF sealed to the outer surface of layer 1104 by positioning the thermoplastic coating on fasteners 1110 in contact with thermoplastic layer 1104.

With ports 1106 and 1108 facing away from layer 1102, layer 1104 and layer 1102 are RF sealed together forming bladder 1100. Hook fasteners 1112 are then RF sealed to the outer surface of layer 1102 as illustrated in FIG. 10. Manufacturing of calf sleeve 6 is completed by inserting pneumatic connectors 13A and 15A into the opening of ports 1106 and 1108 respectively.

FIG. 1 illustrates calf sleeve 6 communicating pneumatically with instrument 2 by means of pneumatic connectors 13 and 15. As described above connector 13A is physically incompatible with connector 15B and does not mate with connector 15B. Connector 15A is physically incompatible with connector 13B and does not mate with connector 13B.

We claim:

1. Apparatus for applying a pressure waveform to a patient's limb for augmenting venous blood flow in the limb, comprising:

an inflatable sleeve adapted for positioning onto a limb to apply a pressure to the limb beneath the sleeve when inflated with gas;

pressure transducing means for sensing the pressure of gas in the sleeve and for producing a sleeve pressure signal indicative of the sensed pressure;

pressure waveform application means responsive to the sleeve pressure signal and a reference pressure waveform signal and operable by supplying gas to the sleeve at a pressure which produces a sensed pressure near a pressure indicated by a reference pressure waveform signal; and waveform register means for producing a reference pressure waveform signal indicative of a reference pressure waveform during a predetermined cycle time period, wherein the amplitude of the reference pressure waveform signal at any time within the cycle time period is indicative of the amplitude of the reference pressure waveform at the time and wherein the variation in amplitude of the reference pressure waveform during a predetermined time interval within the cycle time period is adapted to augment the flow of venous blood into the limb proximal to the sleeve from the limb beneath the sleeve during the predetermined time interval;

wherein the pressure waveform application means includes a microprocessor operable by determining when to increase the pressure of gas supplied to the sleeve, decrease the pressure of gas supplied to the sleeve or maintain the pressure of gas supplied to the sleeve, and by producing a sleeve pressure mode signal having one of a plurality of predefined levels indicative of whether to increase, decrease or maintain the pressure in the sleeve, and wherein the pressure waveform application means further includes a safety circuit operable independently of the microprocessor and responsive to the sleeve pressure mode signal and having a plurality of stored levels for the sleeve pressure mode signal, wherein the safety circuit operates by comparing the level of the sleeve pressure mode signal to the plurality of stored levels for the sleeve pressure mode signal and produces a microprocessor fault signal when the level of the sleeve pressure mode signal does not correspond to one of the sets of stored levels.

2. The apparatus of claim 1 wherein the amplitude of the reference pressure waveform signal varies during the cycle time period to augment the flow of venous blood by increasing the maximum velocity of venous blood flowing in the limb proximal to the sleeve in response to the variation in amplitude during the period.

3. The apparatus of claim 1 wherein the amplitude of the reference pressure waveform varies such that the variation in amplitude of the reference pressure waveform signal during the cycle time period can comprise two or more discrete phases, thereby being adapted to augment the flow of venous blood by increasing the mean velocity of venous blood flow during the period in response to the variation in amplitude.

4. The apparatus of claim 1 wherein the waveform register means further produces the reference pressure waveform signal for a duration of time equivalent to a plurality of cycle time periods and wherein the pressures indicated by the reference pressure waveform signal during the duration correspond to a plurality of reference pressure waveforms repeated periodically at repetition time periods equivalent to the cycle time period.

5. The apparatus of claim 4 and including patient augmentation transducing means for sensing the level of augmentation of venous blood flow produced in response to the variation of pressure during an elapsed time interval within a first repetition time period and for producing a patient augmentation signal indicative of the level of augmentation, and wherein the waveform register means is further responsive to the patient augmentation signal and operable by adapting a parameter of the reference pressure waveform to produce during a corresponding elapsed time interval within a subsequent repetition time period a level of augmentation of venous blood flow greater than the level of augmentation sensed during the elapsed time interval within the first repetition time period.

6. The apparatus of claim 5 wherein the waveform register means adapts the amplitude of the reference pressure waveform so that the ratio of pressures indicated by the amplitudes of the reference pressure waveform signal at any corresponding instants of the elapsed time intervals of the first and subsequent repetition time periods is a fixed ratio determined in response to level of the augmentation sensed during the elapsed time interval within the first repetition time period.

7. The apparatus of claim 1 wherein the pressure waveform application means communicates pneumatically with the sleeve through tubing means, wherein the pressure transducing means communicates pneumatically with the sleeve, and wherein the pressure transducing means only communicates pneumatically with the pressure waveform application means through the sleeve.

8. The apparatus of claim 1 wherein the inflatable sleeve includes a first sleeve connector means communicating pneumatically with the inflatable sleeve and a second sleeve connector means communicating pneumatically with the inflatable sleeve, and wherein the first sleeve connector means does not communicate pneumatically with the second sleeve connector means except through the sleeve.

9. The apparatus of claim 8 wherein the pressure waveform application means includes a pressure waveform application connector for connecting to the first sleeve connector means so that the pressure waveform application means communicates pneumatically with the sleeve, and wherein the pressure transducing means includes a pressure transducing connector for connecting to the second sleeve connector means so that the pressure transducing means communicates pneumatically with the sleeve and communicates pneumatically with the pressure waveform application means only though the sleeve.

10. The apparatus of claim 1 wherein the inflatable sleeve includes an inflating portion and a non-inflating portion and wherein the sleeve applies the pressure to the limb located beneath the inflating portion when the inflating portion is inflated with gas.

11. The apparatus of claim 1 and including:

a second inflatable sleeve adapted to apply pressure to the limb at a second location when inflated with gas;

second pressure transducing means for sensing the pressure of gas in the second sleeve and for producing a second sleeve pressure signal indicative of the sensed pressure in the second sleeve;

second pressure waveform application means responsive to the second sleeve pressure signal and a second reference pressure waveform signal and operable by supplying gas to the second sleeve at a pressure which produces a sensed pressure in the second sleeve near a pressure indicated by a second reference pressure waveform signal; and second waveform register means for producing a second reference pressure waveform signal indicative of a stored second reference pressure waveform, wherein the amplitude of the second reference pressure waveform signal at any time is indicative of the amplitude of the stored second reference pressure waveform at the time.

12. The apparatus of claim 1 and including alarm means responsive to the sleeve pressure signal and the reference pressure waveform signal for producing an alarm signal near an alarm time when the difference between the pressure indicated by the level of the sleeve pressure signal and the pressure indicated by the reference pressure waveform signal is greater than a predetermined pressure difference.

13. The apparatus of claim 12 and including therapy register means responsive to the alarm signal, to the sleeve pressure signal and to the reference pressure waveform signal for recording the amplitudes of the sleeve pressure signal and the reference pressure waveform signal near the alarm time when the alarm signal is produced and for enabling an operator to determine at a time subsequent to the alarm time the sleeve pressure and the reference waveform pressure indicated by the levels of the sleeve pressure signal and the reference pressure waveform signal recorded near the alarm time.

14. The apparatus of claim 1 and including therapy register means responsive to the sleeve pressure signal and to the reference pressure waveform signal for determining the difference between the pressures indicated by the amplitudes of the sleeve pressure signal and the reference pressure waveform signal at a selected time and for recording the selected time if the difference is greater than a predetermined pressure difference.

15. The apparatus of claim 1 wherein the waveform register means includes selector means for enabling an operator to produce an adapted reference pressure waveform by changing the amplitude of the reference pressure waveform at a selected time from a predetermined amplitude to a desired amplitude selected by the operator and wherein the waveform register means further includes configuration register means for enabling the operator to record the adapted reference pressure waveform as the reference pressure waveform for subsequent use.

* * * * *